US008387278B2

(12) United States Patent
Rees

(10) Patent No.: US 8,387,278 B2
(45) Date of Patent: Mar. 5, 2013

(54) SOLE FOR FOOTWEAR

(75) Inventor: Philip Henry Rees, Derby (GB)

(73) Assignee: Langer (UK) Ltd, Stone, Staffordshire (GB)

( * ) Notice: Subject to any disclaimer, the term of this patent is extended or adjusted under 35 U.S.C. 154(b) by 426 days.

(21) Appl. No.: 12/602,647

(22) PCT Filed: Jan. 12, 2009

(86) PCT No.: PCT/GB2009/000067

§ 371 (c)(1),
(2), (4) Date: Mar. 31, 2010

(87) PCT Pub. No.: WO2009/087398

PCT Pub. Date: Jul. 16, 2009

(65) Prior Publication Data

US 2010/0192416 A1 Aug. 5, 2010

(30) Foreign Application Priority Data

Jan. 11, 2008 (GB) ..... 0800430.1

(51) Int. Cl.
*A43B 13/00* (2006.01)

(52) U.S. Cl. ..... 36/25 R; 36/103; 36/142

(58) Field of Classification Search ..... 36/25 R, 36/103, 33, 140, 142–144, 110, 129, 114
See application file for complete search history.

(56) References Cited

U.S. PATENT DOCUMENTS 1,249,667 A * 12/1917 Pruver ..... 36/34 R
2,518,649 A * 8/1950 Tydings et al. ..... 36/144
3,804,099 A * 4/1974 Hall ..... 36/142
3,936,956 A * 2/1976 Famolare, Jr. ..... 36/32 R
4,041,619 A * 8/1977 Sapper ..... 36/25 R
4,224,749 A * 9/1980 Diaz-Cano ..... 36/35 R
4,241,523 A * 12/1980 Daswick ..... 36/30 R
4,425,721 A * 1/1984 Spronken ..... 36/11.5
4,557,059 A * 12/1985 Misevich et al. ..... 36/32 R
5,592,757 A * 1/1997 Jackinsky ..... 36/114
5,826,352 A * 10/1998 Meschan et al. ..... 36/42
6,260,289 B1 * 7/2001 Tsuji ..... 36/103
7,150,114 B2 * 12/2006 Park ..... 36/103
2002/0157279 A1 10/2002 Matsuura
2004/0205983 A1 * 10/2004 Talbott ..... 36/134
2005/0160625 A1 * 7/2005 Whatley ..... 36/25 R
2006/0090372 A1 * 5/2006 Kim ..... 36/25 R
2006/0254093 A1 * 11/2006 Fuchslocher et al. ..... 36/103
2008/0229624 A1 9/2008 Mueller

FOREIGN PATENT DOCUMENTS

DE 2512419 B1 5/1976
DE 2752300 A1 5/1979
EP 0049019 A 4/1982
EP 0860121 A 8/1998

* cited by examiner

*Primary Examiner* — Marie Patterson
(74) *Attorney, Agent, or Firm* — patenttm.us

(57) ABSTRACT

A sole (12) for an item of footwear such as a shoe (10) includes a heel part (18) and a forefoot part (16), the forefoot part (16) including a rocker region (20). The rocker region (20) has a length extending transversely across the sole (12) and a width extending along the sole (12). The sole (12) is arranged so that in use during a gait cycle in which the sole (12) contacts a substantially planar support surface (38), a region of contact between the sole (12) and the support surface (38) moves across the width of the rocker region (20).

13 Claims, 4 Drawing Sheets

SOLE FOR FOOTWEAR

The present invention relates to a sole for footwear, particularly but not exclusively a sole for a shoe.

In diabetes, poor blood flow and nerve damage can lead to the formation of ulcers particularly on the underside of the feet, referred to as the "plantar surface". Ground reaction forces impact the plantar surface of the foot during weight bearing activities such as walking. These ground reaction forces include forces perpendicular to the foot (known as vertical stress) or forces parallel to the foot (known as sheer stress). When these forces work together in a repetitive fashion, ulcers can form on the plantar surface of the foot and people with diabetes are unable to appreciate the increased stress on the plantar surface of the foot due to peripheral nerve damage. In a significant number of cases, ulcers form and become infected, which can lead to prolonged periods of medical intervention and often concludes with the need for amputation.

In this specification, the terms "forward" and "rearward" are used relative to a wearer of the footwear and are equivalent to the anatomical terms "anterior" and "posterior" respectively. The terms "inside" and "inward" refer to the direction towards the other foot and are equivalent to the anatomical term "medial". The terms "outside" and "outward" refer to the direction away from the other foot and are equivalent to the anatomical term "lateral". The terms "upper" and "lower" are used relative to the wearer's foot and are equivalent to the anatomical terms "superior" and "inferior" respectively.

Conventional footwear in combination with a normal gait cycle has been found to provide an uneven weight distribution on the plantar surface of the foot. The path of the mean of the distribution of body weight on the plantar surface of the foot during the gait cycle is referred to as the "centre of pressure pathway". Typically for conventional footwear and a normal gait cycle, the centre of pressure pathway extends from the outside rearward edge of the heel of the plantar surface, along the outside edge of the plantar surface, inwardly along the region behind the metatarsal heads, under the ball of the foot, and then forwardly, leaving the plantar surface of the foot along the big toe. It is in these regions and in particular, the outside edge of the heel and the ball of the foot, where the risk of ulceration is greatest.

According to a first aspect of the present invention, there is provided a sole for an item of footwear such as a shoe, the sole including a heel part and a forefoot part, the forefoot part including a rocker region, the rocker region having a length extending transversely across the sole and a width extending along the sole, the sole being arranged so that in use during a gait cycle in which the sole contacts a substantially planar support surface, a region of contact between the sole and the support surface moves across the width of the rocker region.

Possibly, the sole includes an inside edge and an outside edge. Possible the sole includes a longitudinal axis, which may extend approximately through the mid point of the heel part and approximately through a point below the second toe of the wearer in use.

The sole may be arranged so that, in use, during the gait cycle, a centre of pressure pathway defining the path of the mean of the distribution of weight transmitted through the sole to the support surface passes along the rocker region from the outside edge towards the longitudinal axis. Possibly, the centre of pressure pathway passes forwardly from the rocker region along the longitudinal axis.

Possibly, the rocker region includes a convexly curved face. Possibly, the face is curved about an axis which extends transversely across the sole. Possibly, the axis of curvature subtends an oblique angle to the longitudinal axis when viewed from above. Possibly, the curved face extends from the inside edge to the outside edge. Possibly the radius of curvature of the curved face varies across the sole. Possibly, the radius of curvature increases from the outside edge of the sole to the inside edge.

Possibly when the sole is in an in use unloaded condition, the curved face includes an unloaded contact region, which contacts the support surface. Possibly the curved face unloaded contact region is substantially elongate, and may lie on or along a line, which may extend transversely across the sole. The curved face may include a plurality of unloaded contact regions, each of which contact the support surface in an in use unloaded condition, and which may lie along the line which extends transversely across the sole.

Possibly, the heel part may include a face, which may be substantially planar, and which may slope transversely across the sole relative to the curved face unloaded contact region or regions. Possibly, when viewed substantially along the longitudinal axis, the heel part face subtends a first angle with the curved face unloaded contact region or regions. Possibly, the first angle may be in the region of 2 to 10°, and more possibly may be in the region of 4 to 7°.

Possibly, the heel part includes a contact region, which in an in use unloaded condition contacts the support surface. Possibly the heel part contact region is located at or towards the inside edge of the sole.

The heel part may include one or more relieving faces, which may extend from the face of the heel part. The heel part may include a first relieving face, which may extend obliquely rearwardly and outwardly from the heel part face, and may be convexly curved. The heel part may include a second relieving face, which may extend obliquely forwardly and inwardly from the heel part face.

The sole may be arranged so that, in use, during the gait cycle, a centre of pressure pathway defining the path of the mean of the distribution of weight transmitted through the sole to the support surface passes across the heel part face substantially along the longitudinal axis. Possibly, the centre of pressure pathway passes forwardly from the heel part planar face to the outside edge of the rocker region.

According to a second aspect of the present invention, there is provided an item of footwear such as a shoe, the item of footwear including a sole and an upper, the sole being as described in any of the preceding paragraphs.

An embodiment of the present invention will now be described, by way of example only, and with reference to the accompanying drawings, in which.

Figure 1:
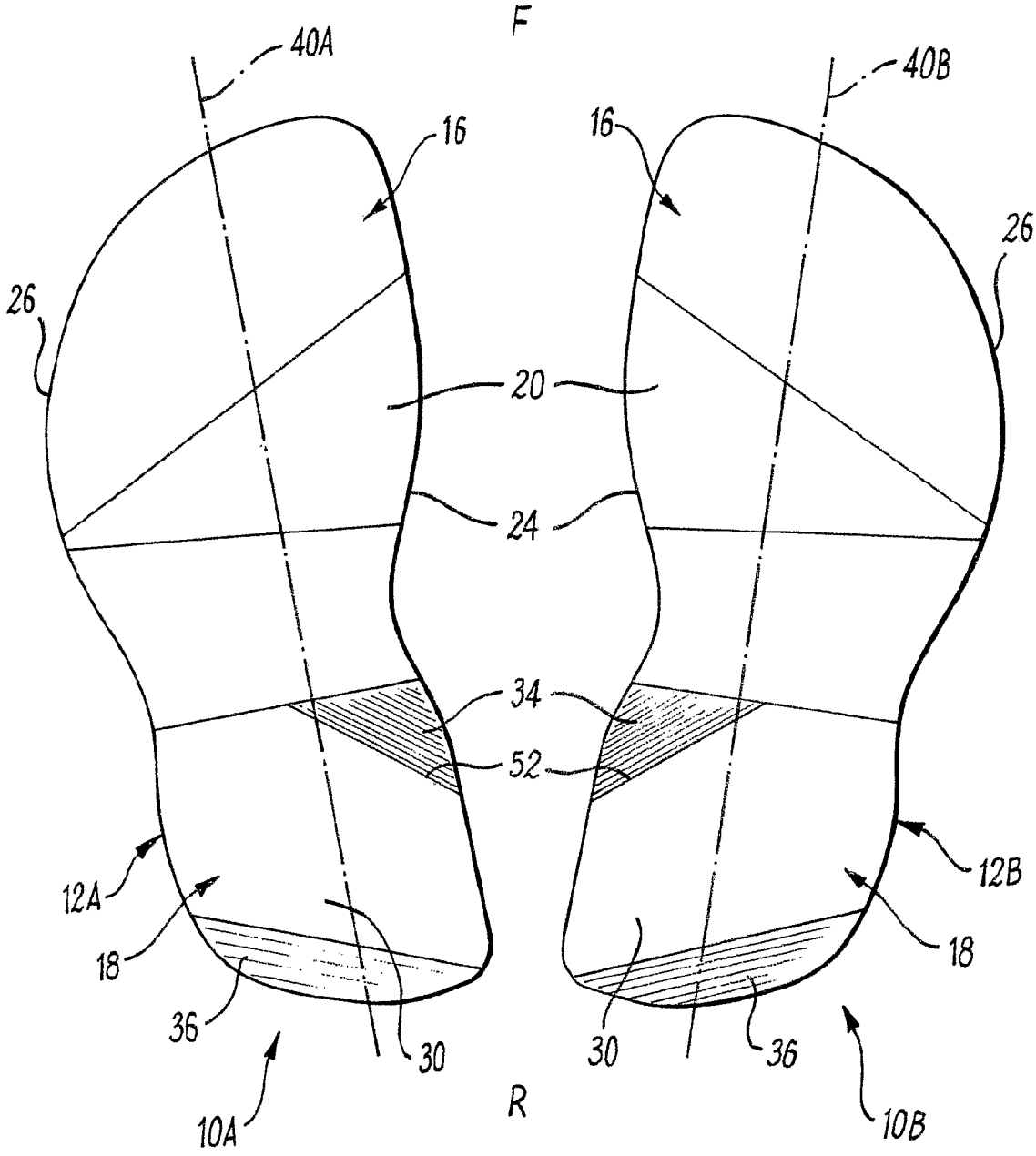
FIG. 1 is a view from below of a pair of shoes.

Referring to FIGS. 1 to 5, a pair of shoes 10 includes a right shoe 10A and a left shoe 10B, each shoe 10 including a sole 12 and an upper 14. As shown in FIG. 1, the letter F denotes a forward direction and the letter R denotes a rearward direction, these directions being relative to a wearer of the shoes 10. Each sole 12 includes an inside edge 24 and an outside edge 26, which are arranged so that when worn by a wearer, the inside edges 24 face each other, and the outside edges 26 face away from each other. Each sole 12A, 12B includes a longitudinal axis 40A, 40B respectively which extends approximately through the mid point of the heel part 18 and approximately through a point below the location of the second toe of the wearer in use at the forefoot part 16.

Each sole 12 includes a heel part 18 and a forefoot part 16. The forefoot part 16 includes a rocker region 20, the rocker region 20 having a length extending across the sole 12 and a width extending along the sole 12.

The rocker region 20 divides the forefoot part 16 into a substantially planar forward region 70 and a substantially planar intermediate region 72, which subtend an angle 74 therebetween. In one example, the said angle 74 could be between 15 and 40°, and ideally could be approximately 30°.

The rocker region 20 includes a convexly curved face 22, which extends transversely across the width of the sole 12 from the inside edge 24 to the outside edge 26. The face 22 is curved about an axis 76 which extends transversely across the sole 12. The axis of curvature 76 subtends an oblique angle 78 to the longitudinal axis 40 when viewed from above. The radius of curvature of the curved face 22 varies across the sole 12, increasing from the outside edge 26 of the sole 12 to the inside edge 24 of the sole 12. Thus the curved face 22 is partially conical.

Figure 2:
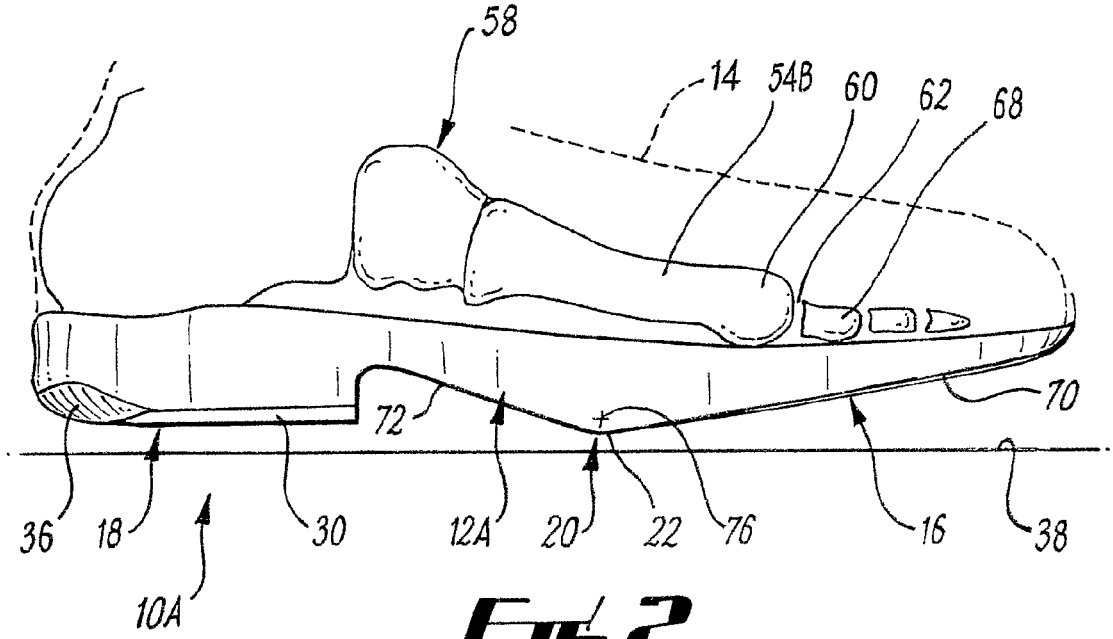
FIG. 2 is a view from one side looking towards an outside edge of the right shoe of the pair.
Figure 3:
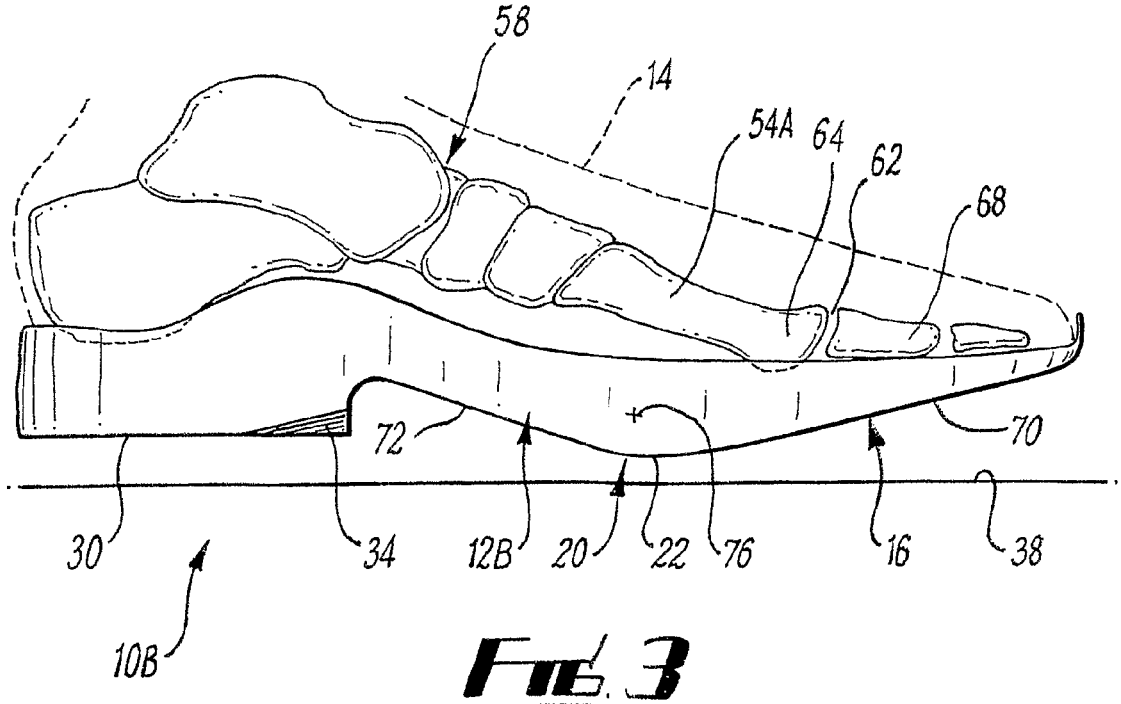
FIG. 3 is a view from the one side looking towards an inside edge of the left shoe of the pair.

FIGS. 2 and 3 show the right and left shoes 10A, 10B in use, being worn by a user and these figures show the relative positions of foot bones 58 to the soles 12. The foot bones 58 include metatarsals 54 and phalanges 68, with a metatarso-phalangeal joint 62 therebetween. In FIG. 3, a head 64 of the first metatarsal bone 54A is visible. In FIG. 2, a head 60 of the fifth metatarsal bone 54B is visible. The axis of curvature 76 is located rearward of the metatarsal heads 60, 64.

In one example, the radius of curvature of the curved face 22 at the inside edge 24 could be similar to or approximately the same as the radius of the head 64 of the first metatarsal bone 54A. In one example, the radius of curvature of the curved face 22 at the outside edge 26 could be similar to or approximately the same as the radius of the head 60 of the first metatarsal bone 54A.

In an unloaded condition (for example when not being worn by a user), with the sole 12 located on a support surface 38 (as indicated in FIGS. 2 and 3), the curved face 22 includes an unloaded contact region 28 which is in contact with the support surface 38. The curved face unloaded contact region 28 is substantially elongate and in the example shown in FIG. 4 extends transversely across the width of the sole 12 in the form of a line. The curved face unloaded contact region 28 is indicated as a hatched region in FIGS. 4 and 5.

The curved face unloaded contact region 28 extends across the sole 12 at an oblique angle to the longitudinal axis 40 when viewed from above, which is the substantially the same angle as the angle 78 between the axis of curvature 76 and the longitudinal axis 40.

Relative to the foot bones 58 shown in FIGS. 2 and 3, the curved face unloaded contact region 28 is located behind the heads 64, 60 of the first and fifth metatarsal bones respectively. In one example, the distance 48 of the curved face unloaded contact region 28 at the inside edge 24 is greater than the distance 46 of the curved face unloaded contact region 28 at the outside edge 26. In one example, the distance 48 at the inside edge 24 could be between 55% and 80% of the total length L of the sole 12. In one example this distance corresponds to approximately the anatomical length of the medial arch of the foot. In one example, the distance 46 at the outside edge 26 is between 50% and 75% of the total length L of the sole 12. In one example this distance corresponds to approximately the anatomical length of the fifth metatarsal bone 54B.

Figure 5:
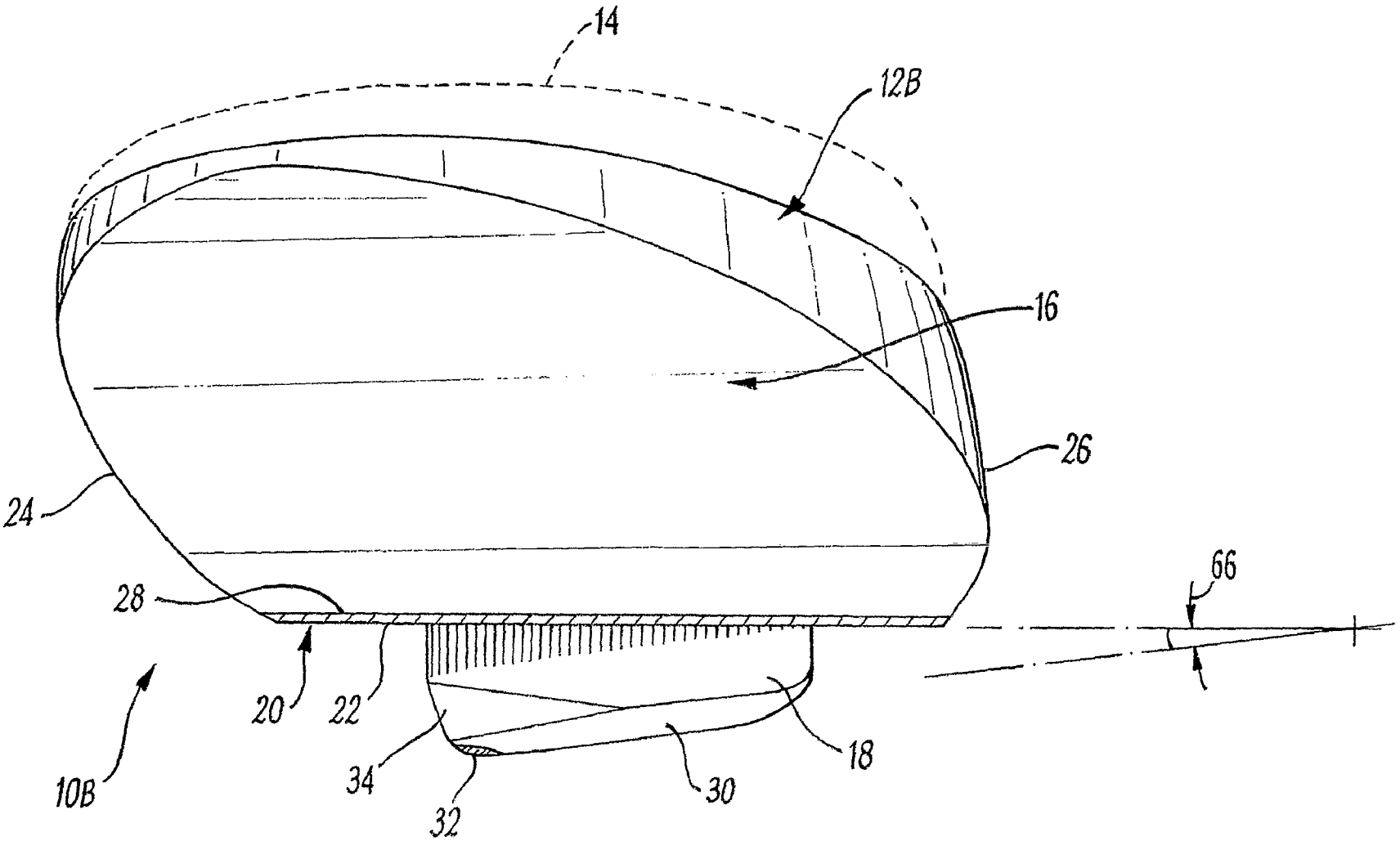
FIG. 5 is a view from the front and below of the left shoe.

The heel part 18 includes a substantially planar face 30. As shown in FIG. 5, the heel part face 30 slopes transversely across the sole 12. The heel part face 30 is angled relative to the curved face contact region 28, subtending an angle 66 therebetween, which in one example could be between 2° and 10°, and ideally is between 4° and 7°. The heel part face 30 extends across the width of the sole 12, and thus the sole 12 is thicker at the inside edge 24 than the outside edge 26.

The heel part face 30 includes a contact region 32, which, in the unloaded condition is in contact with the support surface 38. The heel part unloaded contact region 32 extends at or towards the inside edge 24 of the heel part face 30. The heel part unloaded contact region 32 is shown as a hatched region in FIGS. 4 and 5.

Thus, in the unloaded condition, the only parts of the sole 12 in contact with the support surface 38 are the curved face unloaded contact region 28 and the heel part unloaded contact region 32.

The heel part 18 includes relieving faces, including a first convexly curved relieving face 36 which extends obliquely rearwardly and outwardly from the heel part face 30, and a second relieving face 34, which extends obliquely forwardly and inwardly from the heel part face 30. The first relieving face 36 and the second relieving face 34 are both set at oblique angles to the longitudinal axis 40 when viewed from below. In one example, a line 50 extending along the junction between the heel part face 30 and the first relieving face 36 subtends an angle 42 to the axis 40 when viewed from below, which angle 42 could be less than 90° and greater than or equal to 45°, and optimally could be in the range 60° to 75°. In one example, a line 52 extending along the junction between the heel part face 30 and the second relieving face 34 subtends an angle 44 to the axis 40, which angle 44 could be greater than 90° and less than or equal to 150°, and optimally is in the range 105° to 135°.

In a gait cycle, there are three main phases. The first phase is the contact phase, in which the heel contacts the ground. When wearing conventional footwear, normal contact of the heel is on the rear outside edge of the heel, rather than the rear most edge of the heel, and the rear outside edge of the heel is thus subject to high ground reaction forces and a high risk of potential ulceration.

The contact phase continues until the foot is flat on the ground. The next phase is the mid-stance phase, in which the body weight passes over the foot as the body comes forward. With conventional footwear, the body weight moves from the outside edge of the heel, along the outside edge of the foot to the part of the plantar surface of the foot behind the head of the fifth metatarsal bone, and then along the part of the sole beneath the heads of the metatarsal bones to the ball of the foot beneath the head of the first metatarsal bone. The last phase is the propulsive phase, in which the heel lifts off the ground and the foot pushes against the ground to propel the body forward. In this phase, the body weight is transmitted through the ball of the foot and then the big toe. As will be appreciated, the ball of the foot beneath the head of the first metatarsal bone experiences high forces and pressures is a high risk area for ulceration.

In use, the shoes 10A, 10B of the present invention are fitted to a user. The shoes 10A, 10 could include a cushioned insole (not shown), or an insole which has been cast to accommodate the users foot. The gait cycle of the user wearing the shoes 10A, 10B is as follows.

In the contact phase, the heel part 18 makes contact with the ground, indicated in FIGS. 2 and 3 by the support surface 38. The slope of the heel part planar face 30 is substantially the same as or similar to the natural angle at which most the heel of a typical user will contact the ground 38. The slope and the first relieving face 36 together ensure that, in contrast to the conventional gait cycle described above, weight is borne evenly across the width of the heel part face 30, so that the user's weight is distributed evenly across the user's heel bone.

Figure 4A:
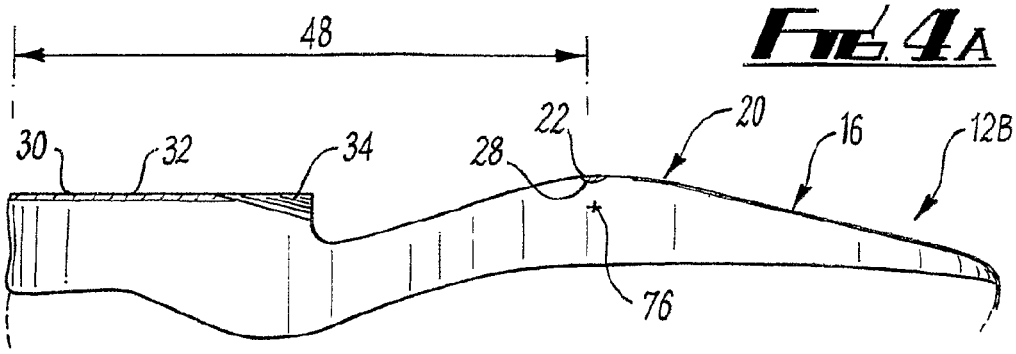
FIG. 4A is a view of the left shoe looking towards the inside edge.
Figure 4B:
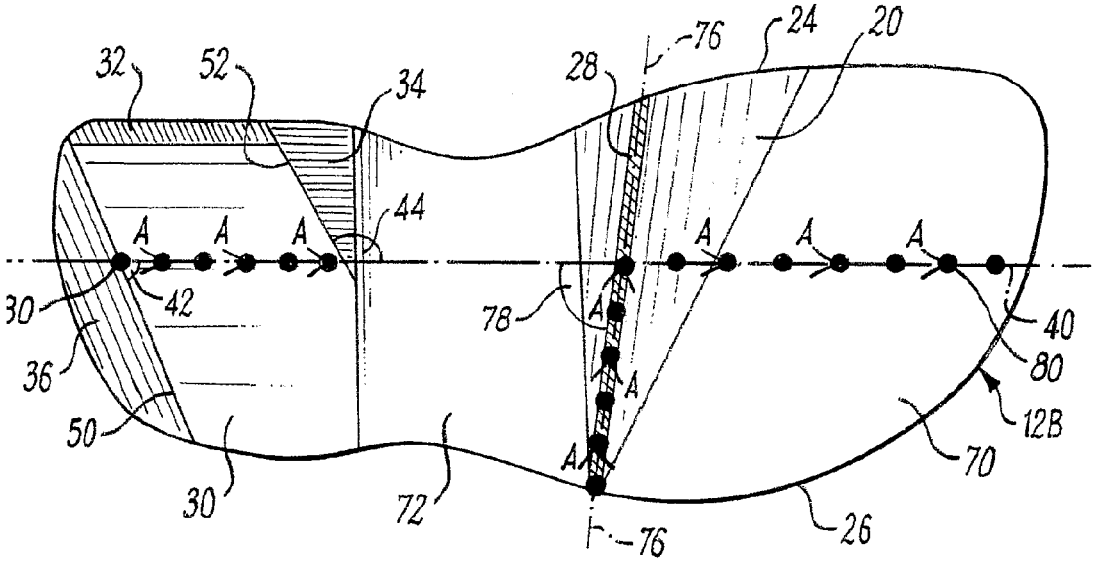
FIG. 4B is a view of the left shoe from below.
Figure 4C:
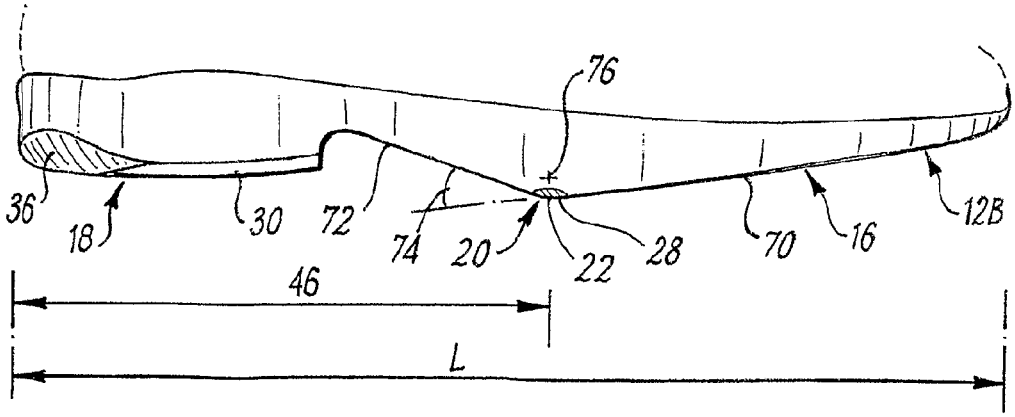
FIG. 4C is a view of the left shoe looking towards the outside edge.

A centre of pressure pathway 80 is shown in heavy dots and arrows A in FIG. 4B. The centre of pressure pathway 80 is the path of the mean of the distribution of weight on the plantar surface during the gait cycle. In the gait cycle of the shoe 10 of the present invention, the centre of pressure pathway 80 passes across the heel part face 30 substantially along the longitudinal axis 40, in contrast to the conventional gait cycle, in which the centre of pressure pathway is located at or towards the outside edge of the sole.

As the user's weight moves forward, the user's weight is directed by the sloping heel part face 30 outwardly towards the outside edge 26 of the shoe 10. With the heel part face 30 in contact with the ground 38, the first part of the curved face 22 to contact the ground 38 is at or towards the outside edge 26.

In the mid stance phase, as the sole 12 is placed flat upon the ground 38, the centre of pressure pathway 80 moves inwardly towards the longitudinal axis 40. In the propulsive phase, the centre of pressure pathway 80 moves substantially forwardly along the longitudinal axis 40. Thus, rather than a significant proportion if not most of the user's weight being directed through the ball of the foot below the head 64 of the first metatarsal bone 54A, the weight is distributed evenly across and behind all of the heads of the metatarsal bones 54 and then across all of the toes.

As the curved face 22 contacts the ground 38 during the gait cycle, a region of contact between the sole 12 and the ground 38 moves from a rearward part of the curved face 22 across the width of the curved face 22 of the rocker region 20.

The partially conical form of the curved face 22 helps to even out the weight distribution across the width of the foot, with a larger radius of curvature of the curved face 22 at the inside edge 24 under the ball of the foot, and a smaller radius of curvature of the curved face 22 at the outside edge 26 under the fifth metatarsal head 60.

The second relieving face 34 permits a rocking movement of the shoe 10 corresponding to a natural foot motion from the contact phase through the mid-stance phase.

Thus, during the gait cycle of a user wearing the shoes 10 of the present invention, the user's weight is distributed more evenly across the foot than with conventional arrangements, reducing pressures in particular at the outside rear edge of the heel, under the ball of the foot and under the big toe, thus reducing the risk of ulceration in these areas for users suffering diabetes.

The shoe soles 12 could be formed of a resiliently flexible material, which could be a plastics material, and could be polyurethane, polyethylene, or a rubber material, or could be any other suitable material. The uppers 14 could be formed of any suitable material, and the uppers 14 and soles 12 could be fixed together in any suitable way.

Various other modifications could be made without departing from the scope of the invention. The soles 12 could be used with any form of footwear such as shoes, boots, clogs, slippers or any other suitable footwear. The different features of the invention as described could be used singly or in any suitable combination.

In one example, the curved face 22 could include a plurality of unloaded contact regions, each of which contact the support surface 38 in an in an unloaded condition, and which lie along a line within the boundary of the unloaded contact region 28 shown in FIG. 4B extending transversely across the sole 12. This could for example be the case when a pattern such as bumps or ridges (not shown) is moulded onto the sole 12 for gripping purposes. Similarly, the heel part face 30 could include a plurality of contact regions which lie substantially within the boundary of the unloaded heel part contact region 32 shown in FIG. 4B.

There is thus provided a sole for an item of footwear such as a shoe, which provides an even distribution of weight across the plantar sole of the foot during the gait cycle, thus reducing the risk of ulceration in diabetic patients.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A sole for an item of footwear such as a shoe, the sole including a heel part and a forefoot part, the forefoot part including a rocker region, the rocker region having a length extending transversely across the sole and a width extending along the sole, in use during a gait cycle in which the sole contacts a substantially planar support surface, a region of contact between the sole and the support surface moves across the width of the rocker region, the rocker region including a convexly curved face having a radius of curvature which increases from an outside edge of the sole to an inside edge of the sole.

2. A sole according to claim 1, in which the sole is arranged so that, in use, during the gait cycle, a centre of pressure pathway defining the path of the mean of the distribution of weight transmitted through the sole to the support surface passes along the rocker region from the outside edge towards the longitudinal axis, preferably the centre of pressure pathway passes forwardly from the rocker region along the longitudinal axis.

3. A sole according to claim 1, in which an axis of curvature subtends an oblique angle to a longitudinal axis when viewed from above.

4. A sole according claim 1, in which the heel part includes a face which is substantially planar, and slopes transversely across the sole relative to the curved face unloaded contact region or regions.

5. A sole according to claim 1, in which when viewed substantially along a longitudinal axis, the heel part face subtends a first angle with the curved face unloaded contact region or regions.

6. A sole according to claim 5, in which the first angle is in the region of 2 to 10°.

7. A sole according to claim 1, in which the heel part includes a contact region, which in an in use unloaded condition contacts the support surface, and the contact region is located at or towards the inside edge of the sole.

8. A sole according to claim 5, in which the heel part includes one or more relieving faces, which extend from the heel part face, and the heel part includes a first relieving face, which extends obliquely rearwardly and outwardly from the heel part face.

9. A sole according to claim 8, in which the first relieving face is convexly curved.

10. A sole according to claim 9, in which the heel part includes a second relieving face, which extends obliquely forwardly and inwardly from the heel part face.

11. A sole according to claim 5, in which the sole is arranged so that, in use, during the gait cycle, a centre of pressure pathway defining the path of the mean of the distribution of weight transmitted through the sole to the support surface passes across the heel part face substantially along the longitudinal axis.

12. A sole according to claim 11, in which the centre of pressure pathway passes forwardly from the heel part planar face to the outside edge of the rocker region.

13. An item of footwear such as a shoe, the item of footwear including a sole and an upper, the sole being according to claim 1.

* * * * *